US011952684B2

(12) United States Patent
Song et al.

(10) Patent No.: US 11,952,684 B2
(45) Date of Patent: Apr. 9, 2024

(54) SHOE UPPER WITH ILLUMINATING LOGO AND SHOES HAVING THE SAME

(71) Applicant: Soo Bok Song, Busan (KR)

(72) Inventors: Soo Bok Song, Busan (KR); Kapsoo Hwang, Busan (KR); Sinje Park, Busan (KR)

(73) Assignee: Soo Bok Song (KR)

( * ) Notice: Subject to any disclaimer, the term of this patent is extended or adjusted under 35 U.S.C. 154(b) by 67 days.

(21) Appl. No.: 17/952,076

(22) Filed: Sep. 23, 2022

(65) Prior Publication Data

US 2023/0089386 A1 Mar. 23, 2023

Related U.S. Application Data

(62) Division of application No. 16/970,616, filed as application No. PCT/KR2019/013547 on Oct. 16, 2019.

(30) Foreign Application Priority Data

Mar. 13, 2019 (KR) ..... 10-2019-0028642
Jun. 26, 2019 (KR) ..... 10-2019-0076562

(51) Int. Cl.

| | |
|---|---|
| ***D03D 13/00*** | (2006.01) |
| ***A43B 3/36*** | (2022.01) |
| ***D03D 15/00*** | (2021.01) |
| ***D03D 15/283*** | (2021.01) |

(Continued)

(52) U.S. Cl.

CPC ..... *D03D 15/547* (2021.01); *A43B 3/36* (2022.01); *D03D 13/00* (2013.01); *D03D 15/00* (2013.01); *D03D 15/283* (2021.01)

(58) Field of Classification Search

CPC ..... D03D 15/547; D03D 13/00; D03D 15/00; D03D 15/283; D03D 13/004; D03D 13/006; D03D 15/54; D03D 19/00; A43B 3/36; A43B 3/38; A43B 3/0078; A43B 23/0205; A43B 23/24; A43B 1/04; A43B 23/02; D10B 2401/20; D10B 2501/043

See application file for complete search history.

(56) References Cited

U.S. PATENT DOCUMENTS 5,813,148 A 9/1998 Guerra
7,021,808 B2 * 4/2006 Currie ..... D07B 1/148 362/556

(Continued)

FOREIGN PATENT DOCUMENTS

CN 201022377 Y * 2/2008 ..... A43B 3/00
CN 101923647 A * 12/2010 ..... G03G 21/046

(Continued)

*Primary Examiner* — Robert H Muromoto, Jr.

(57) ABSTRACT

Disclosed is a shoe upper with an illuminating logo. The upper includes a main body part, a logo part, and a lighting unit, in which the logo part for illumination may be formed integrally with the upper, providing the upper with an illumination feature. In this way, the upper with an illuminating logo can be manufactured with a reduced amount of time, leading to an improved manufacturing efficiency. In addition, the logo part is much less likely to come off and there is no need for an adhesive or bonding, creating an aesthetically attractive appearance from outside.

16 Claims, 10 Drawing Sheets

(51) Int. Cl.
*D03D 15/547* (2021.01)
*D03D 15/20* (2021.01)

(56) References Cited

U.S. PATENT DOCUMENTS 7,432,199 B2 * 10/2008 Lee ..... H01L 27/105 257/E21.597
8,324,051 B2 * 12/2012 Song ..... H01L 29/66825 438/257
9,318,477 B2 * 4/2016 Lee ..... H01L 21/823828
9,557,049 B1 1/2017 Rapisarda
10,227,063 B2 * 3/2019 Abreu ..... B60T 7/14
10,252,145 B2 * 4/2019 Tran ..... G06V 40/28
10,323,840 B1 6/2019 Gou
10,458,616 B2 * 10/2019 Orisich ..... B60Q 1/26
10,703,068 B2 * 7/2020 Dua ..... B32B 5/024
10,759,190 B2 * 9/2020 Collier ..... B41J 11/008
10,969,686 B2 * 4/2021 Hwang ..... G03F 7/0037
11,325,345 B2 * 5/2022 Dua ..... A43D 11/14
11,832,681 B2 * 12/2023 Dua ..... B32B 5/028
2004/0264865 A1 * 12/2004 Joo ..... G02B 6/4202 385/48
2005/0018450 A1 * 1/2005 Chien ..... B60R 11/00 362/565
2006/0221596 A1 10/2006 Chang
2008/0096358 A1 * 4/2008 Lee ..... H01L 27/105 438/301
2010/0321928 A1 12/2010 Yang
2011/0177661 A1 * 7/2011 Song ..... H01L 29/66825 257/E21.422
2012/0222189 A1 9/2012 Sokolowski et al.
2013/0033378 A1 2/2013 Donovan et al.
2015/0077978 A1 3/2015 Chen
2015/0091188 A1 * 4/2015 Lee ..... H01L 27/0207 257/774
2016/0219967 A1 8/2016 Smith et al.
2017/0065011 A1 3/2017 Rapisarda
2017/0198244 A1 7/2017 Göbel et al.
2017/0261670 A1 9/2017 Yamada et al.
2018/0094790 A1 4/2018 Greene et al.
2018/0310659 A1 11/2018 Poupyrev et al.
2018/0341176 A1 * 11/2018 Hwang ..... G03F 7/0002
2019/0110557 A1 * 4/2019 Hobson ..... A43B 23/029
2019/0186057 A1 6/2019 Yamamoto et al.
2019/0289962 A1 * 9/2019 Costa ..... A43B 23/0205
2019/0313172 A1 10/2019 Sunshine et al.
2019/0352808 A1 11/2019 Yoon et al.
2019/0365013 A1 12/2019 Chou
2019/0366680 A1 * 12/2019 Dua ..... A43B 23/026
2019/0387830 A1 * 12/2019 Dua ..... B32B 5/026
2020/0060377 A1 * 2/2020 Dua ..... B32B 5/022
2021/0030102 A1 2/2021 Luh
2021/0030116 A1 2/2021 Bruner
2021/0112921 A1 * 4/2021 Dua ..... B32B 5/26
2021/0227896 A1 7/2021 Zarich et al.
2021/0307449 A1 * 10/2021 Song ..... D03D 13/006
2022/0153037 A1 * 5/2022 Collier ..... B41J 3/407

FOREIGN PATENT DOCUMENTS

JP 2016-037688 A 3/2016
KR 2010-0101331 A 9/2010

* cited by examiner

SHOE UPPER WITH ILLUMINATING LOGO AND SHOES HAVING THE SAME

PRIORITY DATA

This application is a divisional of U.S. patent application Ser. No. 16/970,616, filed on Aug. 17, 2020, which is a 371 U.S. Nationalization of International Patent Application Serial No. PCT/KR2019/013547, filed on Oct. 16, 2019, which claims the benefit of Korean Patent Application Serial No. 10-2019-0028642, filed on Mar. 13, 2019 and Korean Patent Application Serial No. 10-2019-0076562, filed on Jun. 26, 2019, each of which is incorporated herein by reference.

FIELD

The present invention relates to a fiber optic fabric and shoes comprised of a such a fabric, and more particularly, to a pattern formation part having a fiber optic pattern on the surface, a fabric having the same, and shoes or footwear having the upper.

BACKGROUND

In general, a shoe includes a sole which is a part making contact with the floor or ground, and an upper above the sole which is coupled with the sole to cover the foot of the wearer.

By way of enhancing the convenience and efficiency in shoe manufacture, the shoe upper may be woven in one piece. More details on this type of shoe upper, which has already been filed by the same applicant of this invention and granted a patent can be found in Korean Patent Registration No. 10-1437472, titled "Shoe uppers, manufacturing method thereof, and shoes using the same."

There are also shoes having a light emitting function in the art. One example of those shoes is presented in Korean Utility Model Registration No. 29-0278136, titled "Light-up shoes."

However, these conventional shoe uppers and light up shoes have limited functions, such as, flashing lights or lighting surroundings, and contain LEDs simply attached onto the shoe uppers. The manufacture of such shoe uppers takes much time, lowering the manufacturing efficiency, and it is likely that the LEDs are easily detached from the shoe uppers. Besides, the LEDs attached onto the shoe uppers is not aesthetically attractive.

SUMMARY

According to another aspect of the present invention, there is provided a pattern formation part forming a fiber optic pattern on the surface, the pattern formation part being comprised of a fabric made by interweaving first and second warp yarns with first optic fiber weft yarns, wherein at least one of the first and second warp yarns are transparent, transmitting at least part of light. A pattern of the first fiber optic weft yarns is formed on the surface. When either the first warp yarns or the second warp yarns are opaque, not allowing light to pass through, the first weft yarns always go over the opaque warp yarns during the weaving process.

Additionally, or alternatively, both the first warp yarns and the second warp yarns are transparent that transmit at least part of light.

Additionally, or alternatively, the pattern formation part further comprises second weft yarns which are alternately arranged with the first weft yarns next to each other, in which the first and second weft yarns are interwoven with the first and second warp yarns. When either the first warp yarns or the second warp yarns are opaque, not allowing light to pass through, the second weft yarns always go over the opaque warp yarns during the weaving process.

Additionally, or alternatively, the second weft yarns has a certain color. The second weft yarns may be pattern formation weft yarns of a certain color for creating a pattern when the first fiber optic weft yarns are not illuminated.

Additionally, or alternatively, the pattern formation part further back-side weft yarns which are provided at the back of the first weft yarns to prevent backward emission of light from the first weft yarns. The back-side weft yarns are interwoven with at least one of the warp yarns.

In another aspect of the present invention, there is provided a fiber optic fabric comprising: a pattern formation part forming a fiber optic pattern on the surface, and a main body part having a surface free of optical fibers, in which the pattern formation part is comprised of a fabric made by interweaving first and second warp yarns with first optic fiber weft yarns, wherein at least one of the first and second warp yarns are transparent, transmitting at least part of light. A pattern of the first fiber optic weft yarns is formed on the surface. When either the first warp yarns or the second warp yarns are opaque, not allowing light to pass through, the first weft yarns always go over the opaque warp yarns during the weaving process. The main body part is comprised of a fabric made by interweaving first and second main body part warp yarns with first main body part weft yarns. As the first and second warp yarns of the pattern formation part are continuously involved in the weaving process of making the main body part, they constitute the first and second main body part warp yarns, respectively.

Additionally, or alternatively, all the first war yarns, the second warp yarns, the first main body part warp yarns, and the second main body warp yarns can be transparent that transmit at least part of light.

Additionally, or alternatively, the pattern formation part further comprises second weft yarns which are alternately arranged with the first weft yarns next to each other, in which the first and second weft yarns are interwoven with the first and second warp yarns. When either the first warp yarns or the second warp yarns are opaque, not allowing light to pass through, the second weft yarns always go over the opaque warp yarns during the weaving process.

Additionally, or alternatively, the second weft yarns has a certain color. The second weft yarns are pattern formation weft yarns of a certain color for creating a pattern when the first fiber optic weft yarns are not illuminated.

Additionally, or alternatively, the main body part further comprises second main body part weft yarns such that the first and second main body part weft yarns are stacked one on top of the other and interwoven with the first and second main body part warp yarns, and wherein, in at least one portion of the fiber optic fabric, the first main body part weft yarns are exposed on the surface, and the second main body part weft yarns are disposed on the back side such that a pattern of the first main body part weft yarns is formed on the surface of the main body part, and in at least another portion of the fiber optic fabric, positions of the first and second main body part weft yarns are switched around, the first main body part weft yarns being disposed on the back side, and the second main body part weft yarns being exposed on the surface, such that a pattern of the second main body part weft yarns is formed on the surface of the main body part.

Additionally, or alternatively, the main body part weft yarns are involved in the weaving process of making the main body part, and then withdrawn from the weaving process of making the pattern formation part by being taken out to the back side of the fabric from an interface between the fabric and the pattern formation part.

Additionally, or alternatively, the pattern formation part further comprises back-side weft yarns provided at the back of the first weft yarns to prevent backward emission of light from the first weft yarns, with the back-side weft yarns being involved in weaving with at least one of the first and second warp yarns.

Additionally, or alternatively, the main body part weft yarns and the second main body part weft yarns are involved in the weaving process of making the main body part, and then withdrawn from the weaving process of making the pattern formation part by being taken out to the back side of the fabric from an interface between the fabric and the pattern formation part.

Additionally, or alternatively, the pattern formation part further comprises back-side weft yarns provided at the back of the first weft yarns to prevent backward emission of light from the first weft yarns, with the back-side weft yarns being involved in weaving with at least one of the first and second warp yarns.

Additionally, or alternatively, the first main body part weft yarns are continuously involved in the weaving process of making the main body part and the pattern formation part, with the first main body part weft yarns being provided at the back of the first weft yarns of the pattern formation part to prevent backward emission of light from the first weft yarns, and the first main body part weft yarns are interwoven with at least one of the first and second warp yarns.

Additionally, or alternatively, the first main body part weft yarns and/or the second main body part weft yarns are continuously involved in the weaving process of making the main body part and the pattern formation part, with the first main body part weft yarns and/or the second main body part weft yarns being provided at the back of the first weft yarns of the pattern formation part to prevent backward emission of light from the first weft yarns, and the first main body part weft yarns and/or the second main body part weft yarns are interwoven with at least one of the first and second warp yarns.

In another aspect of the present invention, there is provided an upper comprising the pattern formation part according to any of the embodiments of the present invention.

In another aspect of the present invention, there is provided a shoe comprising the upper according to any of the embodiments of the present invention.

Moreover, the pattern formation part and the fabric comprising the same according to an aspect of the present invention are formed by integrally weaving a fiber optic pattern on the surface, instead of forming a separate pattern, such that a luminous effect can be emphasized exclusively and selectively on the pattern (logo) part. This not only improves the manufacturing efficiency of the shoe upper and shoes including the same and ensures that the pattern part is not easily detached from the upper, it also creates an aesthetically attractive appearance through the exclusive and selective luminous effect from the pattern (logo) part.

DETAILED DESCRIPTION

With reference to the drawings, an exemplary embodiment of a shop upper with an illuminating logo according to the present invention and a shoe including the same will be described in detail below.

Woven fabrics can be categorized into single-weave fabrics, double-weave fabrics, pile-weave fabrics, and doup-weave fabrics. They can also be categorized into plain-weave fabrics and leno-weave fabrics. However, the present invention is not limited to thereto.

Figure 1:
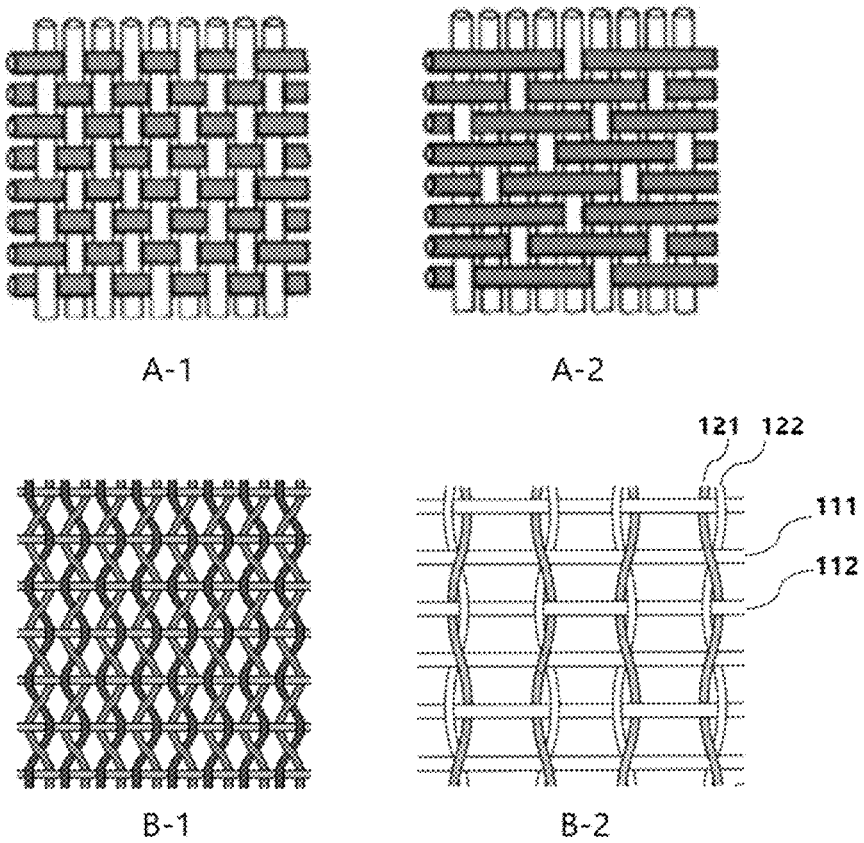
FIG. 1 schematically shows examples of fabrics of plain weave and leno weave.

FIG. 1 schematically shows examples of fabrics of plain weave and leno weave. A-1 and A-2 of FIG. 1 schematically show examples of plain weave, and B-1 and B-2 of FIG. 1 schematically show examples of leno weave.

In plain weave fabric, as shown in A-1 and A-2 of FIG. 1, a single or at least two warp yarns (lengthwise yarns) and a single or at least two weft yarns (crosswise yarns) cross at right angles, going alternately over-and-under. In leno weave fabric, as shown in B-1 and B-2 of FIG. 1, two paired warp yarns are twisted in opposite directions around the weft yarns. To be more specific, a plain weave is created by passing a single (see A-1 of FIG. 1) or at least two (see A-2 of FIG. 1) warp yarns over and under a single or at least two weft yarns, with each row alternating. On the other hand, a leno weave is created by twisting two paired warp yarns are intertwined around the weft yarns, with one of the warp yarns always passing over the weft yarns and the other of the warp yarns always passing under the weft yarns (see B-1 of FIG. 1), or with a first warp yarn 121 of the two paired warp yarns passing over a first weft yarn 111 and then under a second weft yarn 112 neighboring to the first weft yarn 111 and a second warp yarn 122 of the two paired warp yarns passing under the first weft yarn 111 and then over the second weft yarn 112 (see B-2 of FIG. 1). The leno weave is useful for clothing, mesh produce bags (sacks) for onions for example, towels, etc., which require high form stability and breathability. These leno weaves can be formed by a weaving machine having leno heddles, as disclosed in Korean Patent Application Laid-Open Nos. 10-2009-0033764 and 10-2007-0036755.

In general, a fabric is made by passing the warp yarn through a heddle eye in the center of the heddle, following by taking the heddle up and down to let the warp yarn going up and down accordingly and form a hole between neighboring warp yarns, and then inserting the weft yarn into the hole. Depending on the type of a machine used for making holes, fabrics can be classified into dobby fabrics suitable for weaving simple or small geometric patterns and jacquard fabrics suitable for complicated or large geometric patterns.

The dobby fabric for small geometric patterns can be woven using a dobby machine which has 20 to 40 (depending on a desired pattern) heddles fixed onto a harness frame. As the heddles move up and down together, slots are created between the warp yarns under controlled up-and-down movements of the heddles. The weft yarns are then inserted into those slots.

The jacquard fabric can be woven on a jacquard loom, in which each warp yarn is adjusted with an individual heddle, and heddles are not fixed onto a harness frame. As the heddles move up and down, slots are created between the warp yarns under controlled up-and-down movements of the heddles. The weft yarns are then inserted into those slots. Korean Paten Registration No. 10-1419495 described one of conventional jacquard looms.

The following will describe the present invention in detail with reference to the drawings.

One aspect of the present invention provides a pattern formation part having a fiber optic pattern on the surface.

Figure 2:
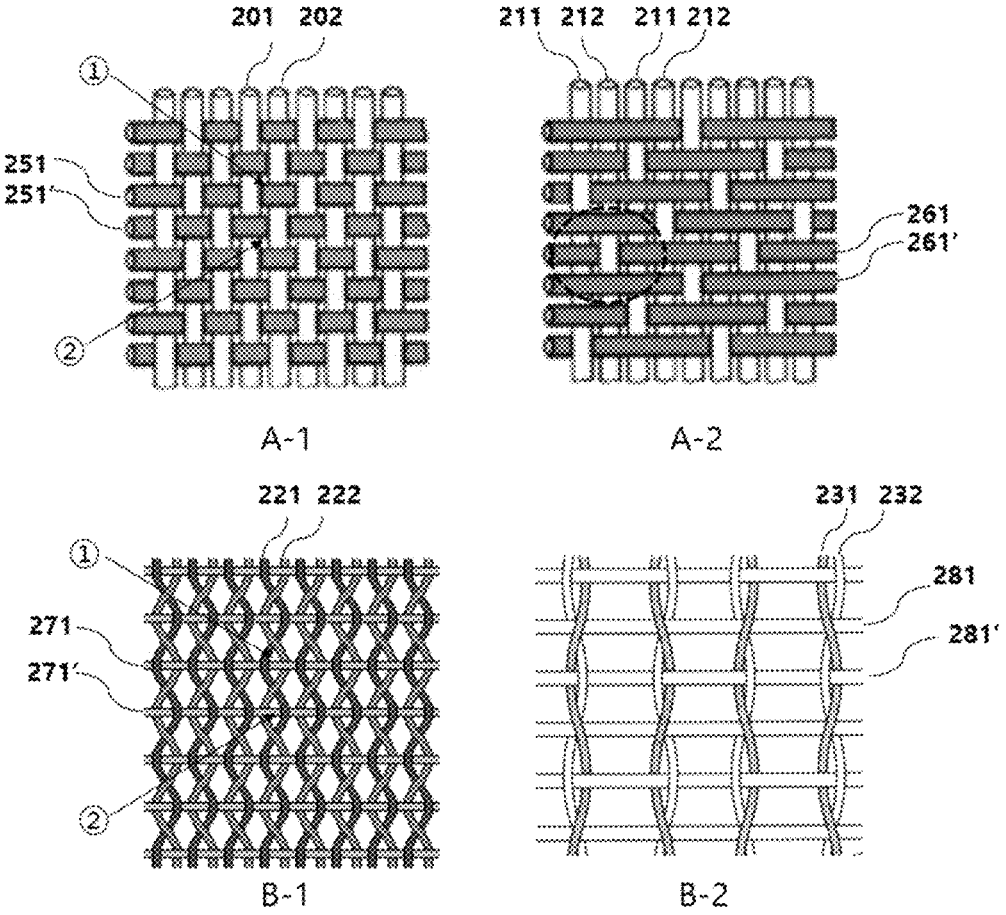
FIG. 2 schematically shows an exemplary embodiment of a pattern formation part according to the present invention.

FIG. 2 schematically shows an exemplary embodiment of the pattern formation part according to one aspect of the present invention.

Referring to FIG. 2, the pattern formation part is a fabric made by interweaving first warp yarns and second warp yarns with first weft yarns, in which at least one of the first and second warp yarns is configured to transmit at least part of light. The first weft yarns form a fiber optic pattern on the surface. If any of the first and second warp yarns is opaque incapable of transmitting the light, the first weft yarns always go over the opaque warp yarns during weaving.

As described above, the pattern formation part in this embodiment can include the first warp yarns and the second warp yarns.

When the pattern formation part of the present invention is a plain-weave fabric, the first warp yarns of the pattern formation part may look like those 201, 211 in A-1 and A-2 of FIG. 2. When the pattern formation part of the present invention is a leno-weave fabric, the first warp yarns of the pattern formation part may look like those 221, 231 in B-1 and B-2 of FIG. 2. However, it should be understood that the present invention is not limited thereto.

Likewise, when the pattern formation part of the present invention is a plan-weave fabric, the second warp yarns of the pattern formation part may look like those 202, 212 in A-1 and A-2 of FIG. 2. When the pattern formation part of the present invention is a leno-weave fabric, the second warp yarns of the pattern formation part may look like those 222, 232 in B-1 and B-2 of FIG. 2. However, it should be understood that the present invention is not limited thereto.

At least one of the first and second warp yarns can be transparent, such that at least part of light can be transmitted. To this end, the transparent warp yarns should be made of a material that is either transparent or translucent at the least. However, the present invention is not limited to particular materials.

The pattern formation part in this embodiment can also include first weft yarns, as mentioned above.

Referring back to FIG. 2, the first weft yarns may look like those 251, 261, 271, 281 in A-1, A-2, B-1 and B-2. However, it should be understood that the present invention is not limited thereto.

The first weft yarns of the pattern formation part of the present invention may be fiber optic weft yarns.

The optical fiber is a transparent thread-like fiber made of glass or plastic materials having a diameter of several hundred to several thousand micrometers (μm) (1 μm equals to 1/1000 mm), for example, 125 to 3000 μm. Usually, it has a double-walled cylinder structure including a core with a high refractive index in the center and a cladding portion with a low refractive index that encompasses the core. Thus, the light passing through the core in the center can be totally reflected, which in turn minimize light loss and enables light emission to a longer distance. Depending on the application, two different types of optical fiber may be used, which include end lighting fibers that emit the light only from the fiber end, and side lighting fibers that constantly emit the light from the side of the fiber. Any of the end lighting fibers and the side lighting fibers may be applicable to the first fiber optic weft yarns of the pattern formation part. For example, the pattern formation part of the present invention includes the optical fiber as the first weft yarns, and the ends of the optical fiber can be tied to a bundle and connected to a light source unit. Here, the optical fiber bundle may be inserted into an opaque tube that does not transmit the light. It has been confirmed that both the end lighting fibers and the side lighting fibers are suitable for the first weft yarns of the pattern formation part in the present invention.

The pattern formation part may be a fabric formed by interweaving the first and second warp yarns with the first weft yarns together. This means that the first warp yarns 201, 211 and the second warp yarns 202, 212 may be placed one after the other in a row and the first weft yarns 251, 261 cross at right angles to the warp yarns, going alternately over-and-under to form a plain-weave fabric, as shown in A-1 and A-2 in FIG. 2. Alternatively, the first warp yarns 221, 231 and the second warp yarns 222, 232 may be twisted in opposite direction around the first weft yarns 271, 281 to form a leno-weave fabric, as shown in B-1 and B-2 in FIG. 2.

As discussed earlier, the pattern formation part of the present invention may be a fabric having a fiber optic pattern on the surface that is obtained by an optical fiber for the first weft yarns of the pattern formation part. Therefore, upon receiving the light from the light source unit (not shown), the first fiber optic weft yarns will be lighted in their corresponding areas to form an intended illuminating pattern.

Additionally, if either the first warp yarns or the second warp yarns may be opaque, not allowing the light to pass through, the first weft yarns always go over those opaque yarns during weaving. To explain further with reference to FIG. 2, at least one of the first warp yarns and the second warp yarns can be transparent, allowing light at least partly to pass through. The following will describe two cases where both the first warp yarns and the second warp yarns are transparent, and one of them is light-impermeable or opaque.

When both the first warp yarns and the second warp yarns are transparent, the first weft yarns of the pattern formation part of the present invention can go over or under the first warp yarns and/or the second warp yarns. In this case, since both the first warp yarns and the second warp yarns are transparent, even if the first weft yarns would go under the warp yarns, at least part of light emitted from the first weft yarns will transmit through the warp yarns. As a result, a pattern by the first fiber optic weft yarns can be formed on the surface of the pattern formation part.

On the other hand, when either the first warp yarns or the second warp yarns are opaque, not allowing the light to pass through, the first weft yarns always go over those opaque warp yarns during weaving. Referring again to A-2 in FIG. 2, for example, when the first warp yarns 211 are opaque and the second warp yarns 212 are transparent, the first fiber optic weft yarns 261 always go over the first opaque warp yarns 211, during weaving (see the red circle parts, they are presented as a reference only as other parts may not correspond to this).

Referring now to B-1 in FIG. 2, for example, when the first warp yarns 221 are transparent and the second warp yarns 222 are opaque, the first fiber optic weft yarns 271 always go over the second opaque warp yarns 222 during weaving.

Another exemplary embodiment in an aspect of the present invention provides a pattern formation part in which both the first warp yarns and the second warp yarns are transparent that transmit at least part of light. If this the case, the weft yarns may go either over or under the warp yarns during the weaving process of making the pattern formation part. Now that the weft yarns are only taken into consideration for patterning without worrying about the direction the yarns need to go, the manufacturing efficiency of the pattern formation part can be maximized. Any material that transmits at least part of light can be used for the transparent warp yarns in the present invention.

Another exemplary embodiment in an aspect of the present invention provides a pattern formation part that further includes second weft yarns.

In particular, the pattern formation part further includes second weft yarns that are arranged alternately with the first weft yarns in a row. That is, the first weft yarns and the second weft yarns are placed one after the other consecutively in a row, as seen on the same plane of the pattern formation part.

Also, the second weft yarns arranged next to the first weft yarns may be woven with the first and second warp yarns. In particular, during weaving, the first and second weft yarns run through the same slot together or different slots separately, which are formed by the first and second warp yarns (this is relevant to a plain weave as well as a leno weave).

When the first warp yarns or the second warp yarns are opaque, not allowing the light to pass through, the second weft yarns always go over the opaque warp yarns during weaving.

To elaborate the exemplary embodiment of the pattern formation part further including the second weft yarns according to the present invention, the first and second weft yarns run through the same slot together that are formed by the first and second warp yarns (this is relevant to a plain weave as well as a leno weave) during weaving, which also occurs whether or not the weft yarns are comprised of first and second weft yarns. For example, as shown in A-1, A-2, B-1 and B-2 of FIG. 2, the weft yarns include the first and second weft yarns 251, 261, 271, 281, and these paired weft yarns are then interwoven with the first and second warp yarns. In this case, the first and second weft yarns run through the same slot together that are formed by the first and second warp yarns. Similar to the first weft yarns, when the first warp yarns or the second warp yarns are opaque, not allowing the light to pass through, the second weft yarns always go over the opaque warp yarns during weaving.

In another exemplary embodiment of the pattern formation part further including the second weft yarns according to the present invention, the first and second weft yarns run through different slots separately that are formed by the first and second warp yarns (this is relevant to a plain weave as well as a leno weave) during weaving. In particular, referring to the plain weave as shown in A-1 and A-2 of FIG. 2, the first weft yarns 251, 261 run through a slot (①) formed by the first warp yarns 201, 211 and the second warp yarns 202, 212, and the second weft yarns 251', 261' run through another slot (②) formed by the first warp yarns 201, 211 and the second warp yarns 202, 212. Referring now to the leno weave as shown in B-1 of FIG. 2, the first weft yarns 271 and the second weft yarns 271' are alternately arranged next to each other, and the first weft yarns 271 run through a slot (①) formed by the twisted first and second warp yarns 221, 222 crossing each other, and the second weft yarns 271' run through another slot (②) formed by the twisted first and second warp yarns 221, 222 crossing each other. Referring next to another type of the leno weave as shown in B-2 of FIG. 2, the first weft yarns 281 are placed at twist nodes of the first warp yarns 231 and the second warp yarns 232, and the second weft yarns 281' are placed, adjacent to the first weft yarns 281, and can be woven between the twisted first and second warp yarns 231, 232. Again, similar to the first weft yarns 271, when the first warp yarns or the second warp yarns are opaque, not allowing the light to pass through, the second weft yarns 271' always go over the opaque warp yarns during weaving.

In the present invention, the second weft yarns may be pattern formation weft yarns of a certain color. Thus, when the first fiber optic weft yarns are not illuminated, there will still be a colored pattern formed by the second weft yarns.

Another exemplary embodiment in an aspect of the present invention provides a pattern formation part further including back-side weft yarns.

In particular, the back-side weft yarns of the pattern formation part are arranged at the back of the first weft yarns to prevent backward emission of the light from the first weft yarns. The back-side weft yarns can be woven with at least one of the warp yarns. As described earlier, the first weft yarns are made of optical fibers such that light emitted from the optical fibers can be directed not only toward the surface of a fabric of the pattern formation part but also toward the back side, possibly causing light loss. Therefore, having the back-side weft yarns at the back of the first weft yarns according to the present invention can reduce the light loss by preventing backward emission of the light from the optical fibers, and allow the formation of a pattern with high-efficiency optical fibers.

As mentioned above, at least one of the warp yarns can be woven together with the back-side weft yarns.

In particular, according to the exemplary embodiment, the first weft yarn is woven with at least one of the warp yarns that are also involved in the weaving process with the back-side weft yarns. Here, the number of warp yarns involved in weaving with the first weft yarns may be equal to or smaller than the number of warp yarns involved in the weaving process with the back-side weft yarns. In this way of weaving, the first weft yarns may be placed in front of (over) the back-side weft yarns during weaving with the warp yarns. Alternatively, if the back-side weft yarns and the first weft yarns are stacked together, the first weft yarns may also be placed in front of (over) the back-side weft yarns during weaving with the warp yarns. In this case, both the first weft yarns and the back-side weft yarns are involved in the weaving process of making the pattern formation part.

In another exemplary embodiment, the back-side weft yarns may be woven with at least one of the warp yarns involved in the weaving process with the first weft yarns. In this embodiment, the back-side weft yarns are arranged at the back of the first weft yarns and woven with the corresponding warp yarns. Here, the back-side weft yarn together with the first weft yarn may be woven with the warp yarns, or the back-side weft yarn may be woven with at least one of the warp yarns, separately from the first weft yarn. In the latter case, the back-side weft yarn may be woven with at least one of the warp yarns during the weaving process of the first weft yarns and the corresponding warp yarns, getting involved in the weaving process of making the pattern formation part. Then it may be withdrawn from the weaving process by not being woven with any of the warp yarns but taken out to the back side of the pattern formation part. Later, it comes back to the weaving process by being woven with at least one of the warp yarns for weaving the pattern formation part. That is to say, the back-side weft yarn may be sparsely woven with at least one of the warp yarns that are woven with the first weft yarn.

Another aspect of the present invention provides a fiber optic fabric which includes a pattern formation part having a fiber optic pattern on the surface, and a main body part having an optical fiber-free surface.

Figure 3A:
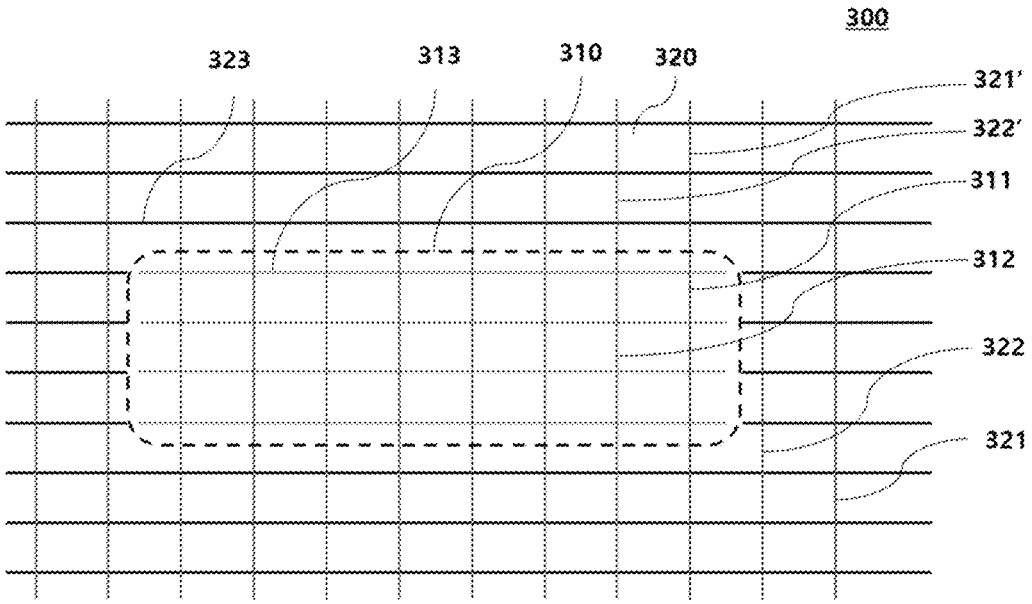
FIG. 3A schematically shows an exemplary embodiment of a fiber optic fabric according to the present invention.

FIG. 3A is a schematic plan view of an exemplary embodiment of a fiber optic fabric 300 in another aspect of the present invention.

Referring to FIG. 3A, the fiber optic fabric 300 includes a pattern formation part 310 having a fiber optic pattern on the surface, and a main body part 320 having an optical fiber-free surface. The pattern formation part 310 is a fabric formed by interweaving first and second warp yarns 311, 312 with first fiber optic weft yarns 313, in which the first warp yarns 311 and/or the second warp yarns 312 are transparent to transmit at least part of light, and if either the first warp yarns 311 or the second warp yarns 312 are opaque, not allowing the light to pass through, the first weft yarns 313 always go above the opaque warp yarns during weaving. The main body part 320 is a fabric formed by interweaving first and second main body part warp yarns 321, 322 with first main body part weft yarns 323, in which the first warp yarns 311 and the second warp yarns 312 of the pattern formation part 310 are continued across the main body part 320, forming first main body warp yarns 321' and second main body part warp yarns 322'.

The pattern formation part 310 of the fiber optic fabric 300 shown in FIG. 3A has a fiber optic pattern on the surface, and the surface of the main body part 320 is free of optical fibers, as mentioned above.

This fiber optic fabric 300 is schematically represented in a plan view in FIG. 3A. That is, it is a schematic view of a sheet of the fabric 300 having weft yarns and warp yarns, as viewed from the top.

To elaborate, the fiber optic fabric 300 of the present invention includes the pattern formation part 310 (indicated by red dotted lines in FIG. 3A) having a fiber optic pattern on the surface, and the main body part 320 having an optical fiber-free surface. Referring again to FIG. 3A, the pattern formation part 310 may be provided in the center, and the main body part 320 may be provided in the other areas, i.e., on the right and left and up and down sides of the pattern formation part 310.

As can be seen from FIG. 3A showing a schematic configuration of weft yarns and warp yarns, it should be understood that the weft yarns and the warp yarns can be woven in plain or leno weave throughout the fabric, or the weft yarns and the warp yarns can continuously be woven in plain weave in some areas and in leno weave in other areas, but the present invention is not limited thereto. For example, in case of a plain-weave fabric, the warp yarns 311 and 312, 321 and 322 are alternately arranged next to each other, and the consecutive weft yarns 313, 323 are also arranged crossly, running through the slots formed during vertical movement of the warp yarns. In case of a leno-weave fabric, on the other hand, each paired warp yarns 311 and 312, 321 and 322 are twisted around the weft yarns 313, 323, and the weft yarns 313, 323 run through the slots formed by the twists of the warp yarns.

As described earlier, the pattern formation part 310 included in the fiber optic fabric 300 of FIG. 3A is a fabric formed by interweaving the first and second warp yarns 311, 312 with the first fiber optic weft yarns 313, in which the first warp yarns 311 and/or the second warp yarns 312 are transparent to transmit at least part of light, and if either the first warp yarns 311 or the second warp yarns 312 are opaque, not allowing the light to pass through, the first weft yarns 313 always go above the opaque warp yarns during weaving. More details on the pattern formation part 310 of the fiber optic fabric 300 in this embodiment can be referred to the description of the pattern formation part with reference to FIG. 2.

Going back to FIG. 3A, the main body part 320 of the fiber optic fabric 300 of the present invention is a fabric formed by interweaving the first and second main body part warp yarns 321, 322 with the first main body part weft yarns 323. Similar to the pattern formation part discussed previously, it should be understood that the first main body part warp yarns 321 and the second main body part warp yarns 322 can be woven in plain or leno weave throughout the fabric, or the weft yarns and the warp yarns can continuously be woven in plain weave in some areas and in leno weave in other areas, but the present invention is not limited thereto. Again, as discussed earlier, in case of a plain-weave fabric, for example, the warp yarns 321 and 322 are alternately arranged next to each other, and the consecutive weft yarns 323 are also arranged crossly, running through the slots formed during vertical movement of the warp yarns. In case of a leno-weave fabric, on the other hand, the paired warp yarns 321 and 322 are twisted around the weft yarns 323, and the weft yarns 323 run through the slots formed by the twists of the warp yarns.

The first warp yarns 311 and the second warp yarns 312 of the pattern formation part 310 included in the fiber optic fabric of the present invention are continued across the main body part 320, forming first main body part warp yarns 321' and second main body part warp yarns 322'. In other words, referring to FIG. 3A, as the main body part 320 is placed over and under the pattern formation part 310, the pattern formation part 310 and the main body part 320 are woven using the same type of warp yarns. This means that the first warp yarns 311 are the same as the first main body part warp yarns 321', and the second warp yarns 312 are the same as the second main body part warp yarns 322'. In this way, the pattern formation part 310 together with the main body part 320 may form the fiber optic fabric.

If the main body part 320 is placed on the right and left sides of the pattern formation part 310, an interface is created between the main body part 320 and the pattern formation part 310. This will be described below.

Additionally, or alternatively, in the fiber optic fabric of the present invention, each of the first and second warp yarns of the pattern formation part and each of the first and second main body part warp yarns of the main body part can be transparent that transmit at least part of light. When both the first and second warp yarns of the pattern formation part are transparent, allowing at least part light to pass through, the weft yarns may go either over or under the warp yarns during the weaving process of making the pattern formation part. Now that the weft yarns are only taken into consideration for patterning without worrying about the direction the yarns need to go, the manufacturing efficiency of the pattern formation part can be maximized. Likewise, when both the first and second main body part warp yarns of the main body part are transparent, allowing at least part of light to pass through, the weft yarns may go either over or under the warp yarns during the weaving process of making the pattern formation part. Now that the weft yarns are only taken into consideration for patterning in particular colors as desired without worrying about the direction the yarns need to go, the manufacturing efficiency of the main body part can be maximized. Additionally, or alternatively, given that all of the warp yarns are transparent that can transmit at least part of light as mentioned above, the same type of transparent warp yarns may be employed for the first and second warp yarns of the pattern formation part and for the first and second main body part warp yarns of the main body part, such that the main body part and the pattern formation part can be manufactured at a higher efficiency. Any material that transmits at least part of light can be used for the transparent warp yarns in the present invention.

In an exemplary embodiment of a fiber optic fabric in another aspect of the present invention, the pattern formation part further includes second weft yarns.

Figure 3B:
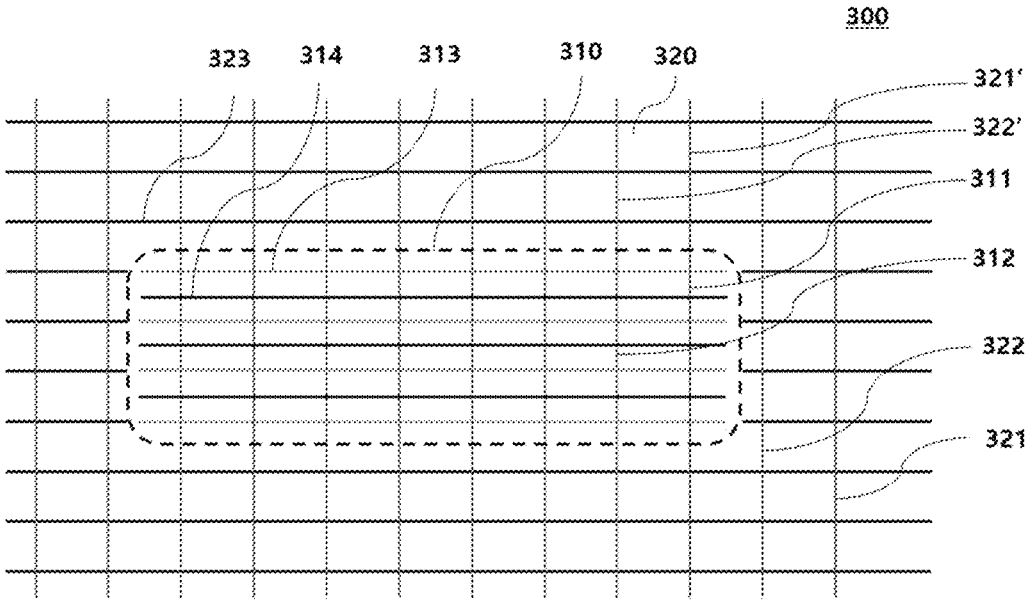
FIG. 3B schematically shows an exemplary embodiment of a fiber optic fabric according to the present invention.

FIG. 3B is a schematic plan view of an exemplary embodiment of a fiber optic fabric in another aspect of the present invention.

The pattern formation part included in the fiber optic fabric shown in FIG. 3B further includes second weft yarns 314, such that the first weft yarns 313 and the second weft yarns 314 are arranged alternatively next to each other. Similar to the first weft yarns 313, the second weft yarns 314 are interwoven with the first and second warp yarns 311, 312, and when either the first warp yarns 311 or the second warp yarns 312 are opaque, not allowing light to pass through, the second weft yarns 314 always go over the opaque warp yarns during weaving. More details on the pattern formation part can be referred back to the description on any of the pattern formation parts discussed previously.

As discussed earlier, the second weft yarns may be pattern formation weft yarns of a certain color. Thus, when the first fiber optic weft yarns are not illuminated, there will still be a colored pattern formed by the second weft yarns.

In an exemplary embodiment of a fiber optic fabric in another aspect of the present invention, the main body part further includes second main body part weft yarns.

Figure 4:
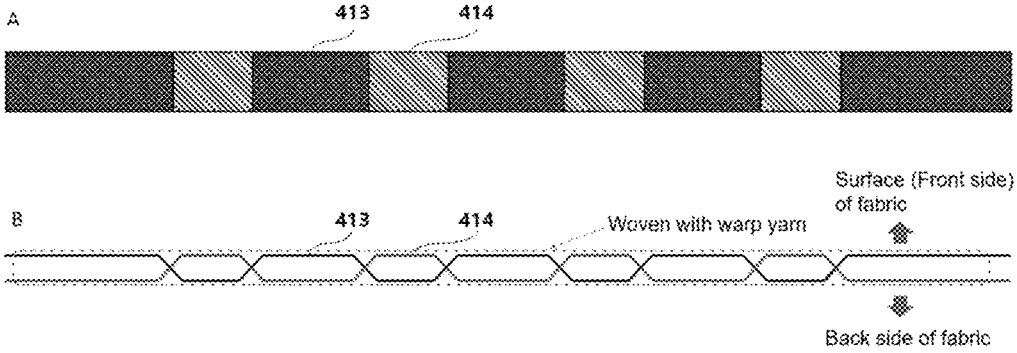
FIG. 4 schematically shows a main body that may be included in an exemplary embodiment of a fiber optic fabric according to the present invention, in which the main body further includes a second main body weft.

This main body part further including the second main body part weft yarns is schematically shown in FIG. 4.

As can be seen from FIG. 4, in the main body part of the fiber optic fabric, a first main body part weft yarn 413 and a second main body part weft yarn 414 are stacked one on top of the other and interwoven with first and second main body part warp yarns (not shown). In at least one portion of the fiber optic fabric, the first main body part weft yarns 413 are exposed on the surface, and the second main body part weft yarns 414 are disposed on the back side, such that a pattern of the first main body part weft yarns 413 is formed on the surface of the main body part. In at least another portion of the fiber optic fabric, positions of the first and second main body part weft yarns are switched around, namely, the first main body part weft yarns 413 are now disposed on the back side, and the second main body part weft yarns 414 are exposed on the surface, such that a pattern of the second main body part weft yarns 414 is formed on the surface of the main body part. Depending on a desired weave, either the first main body part weft yarns 413 or the second main body part weft yarns 414, whichever are supposed to be exposed on the surface of the fabric, will be interwoven with the warp yarns.

Additionally, or alternatively, in the fiber optic fabric in another aspect of the present invention, the first main body part weft yarns may be involved in the weaving process of making the main body part, and then withdrawn from the weaving process of making the pattern formation part by being taken out to the back side of the fabric from an interface between the fabric and the pattern formation part.

Figure 5A:
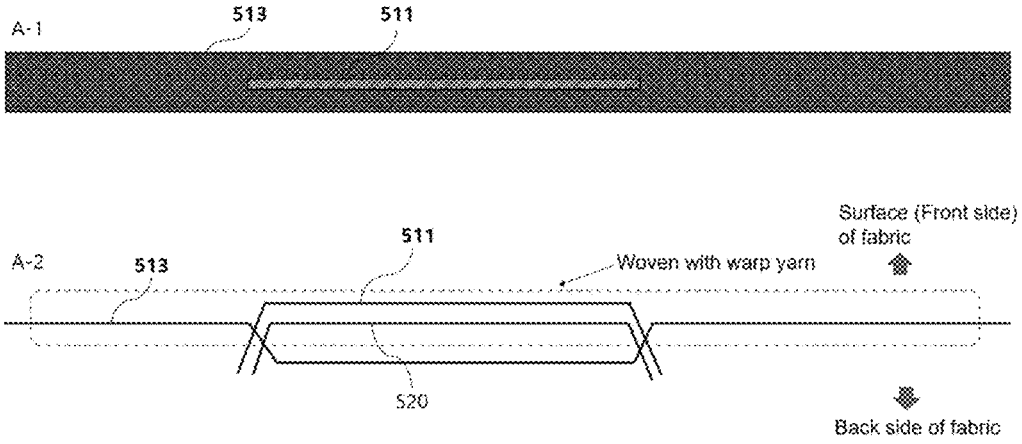
FIG. 5A is a schematic view of an exemplary embodiment of a fiber optic fabric according to the present invention.
Figure 5B:
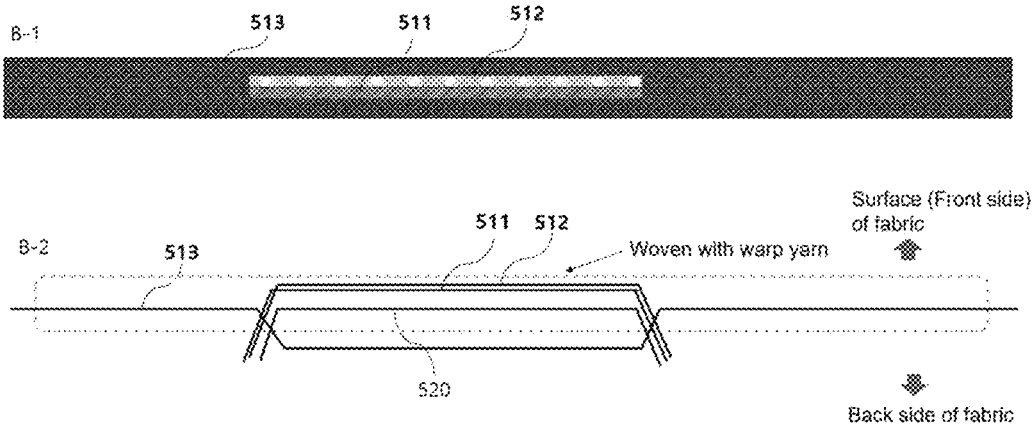
FIG. 5B is a schematic view of an exemplary embodiment of a fiber optic fabric according to the present invention.

FIGS. 5A and 5B schematically show a fiber optic fabric according to the present invention. In particular, FIG. 5A is a schematic view of the fabric that includes the pattern formation part with a first weft yarn, and the main body part with a first main body part weft yarn. FIG. 5B is a schematic view of the fabric that includes the pattern formation part with a second weft yarn in addition to the first weft yarn, and the main body part with the first main body part weft yarn.

To elaborate, A-1 of FIG. 5A is a plan view of the fabric that includes the pattern formation part with a first weft yarn 511, and the main body part with a first main body part weft yarn 513; and A-2 in FIG. 5A is a front view of the fabric. Referring to FIG. 5A, the pattern formation part can be made by interweaving the first weft yarn 511 with first and second warp yarns (not shown), and the main body part can be made by interweaving the first main body part weft yarn 513 with first and second main body part warp yarns (not shown). Here, the first main body part weft yarn 513 may be involved in the weaving process of making the main body part, and then withdrawn from the weaving process of making the pattern formation part by being taken out to the back side of the fabric from an interface between the fabric and the pattern formation part.

B-1 of FIG. 5B is a plan view of the fabric that includes the pattern formation part with the first weft yarn 511 as well as a second weft yarn 512, and the main body part with the first main body part weft yarn 513; and B-2 of FIG. 5B is a front view of the fabric. Referring to FIG. 5B, the first weft yarn 511 and the second weft yarn 512 are arranged alternately next to each other, as seen on the same plane. In particular, the plan view in B-1 of FIG. 5B shows that the first weft yarn 511 and the second weft yarn 512 are alternately arranged side by side, while the front view in B-2 of FIG. 5B shows that these two weft yarns are slightly out of phase such that both the weft yarns are visible, instead of having either the first weft yarn 511 or the second weft yarn 512 hidden from the view as they are actually overlapped when seen from the front view.

Referring back to FIG. 5B, the pattern formation part can be made by interweaving the first and second weft yarns 511, 512 with first and second warp yarns (not shown), and the main body part can be made by interweaving the first main body part weft yarn 513 with first and second main body part warp yarns (not shown). Here, the first main body part weft yarn 513 may be involved in the weaving process of making the main body part, and then withdrawn from the weaving process of making the pattern formation part by being taken out to the back side of the fabric from an interface between the fabric and the pattern formation part.

In this fabric having the first main body part weft yarn involved in the weaving process of making the main body part, and then withdrawn from the weaving process of making the pattern formation part by being taken out to the back side of the fabric from an interface between the fabric and the pattern formation part, the pattern formation part may further include a back-side weft yarn.

Having such a back-side weft yarn 520 at the back of the first weft yarn 511 as shown in FIGS. 5A and 5B, it becomes possible to prevent backward emission of light from the first weft yarn 511. That is, the back-side weft yarn 520 and the first weft yarn 511 are stacked one on top of the other, and in particular, the back-side weft yarn 520 is arranged at the back of the first weft yarn 511 as seen on the same plane of the fabric so that it becomes possible to prevent backward emission of the light from the first weft yarn 511 and maximize forward light emission.

In this pattern formation part, the back-side weft yarn 520 can be woven with at least one of first and second warp yarns (not shown). More details on the structure of the back-side weft yarn can be referred back to the description on any of the pattern formation parts discussed previously.

In this embodiment of the main body part that further includes the second main body part weft yarns, the first and second main body part weft yarns may be involved in the weaving process of making the main body part, and then withdrawn from the weaving process of making the pattern formation part by being taken out to the back side of the fabric from an interface between the fabric and the pattern formation part.

Figure 6A:
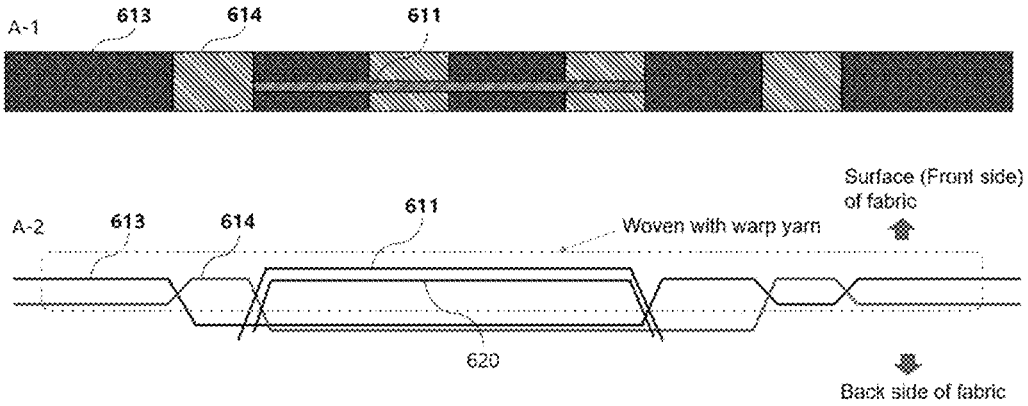
FIG. 6A is a schematic view of another exemplary embodiment of a fiber optic fabric according to the present invention.
Figure 6B:
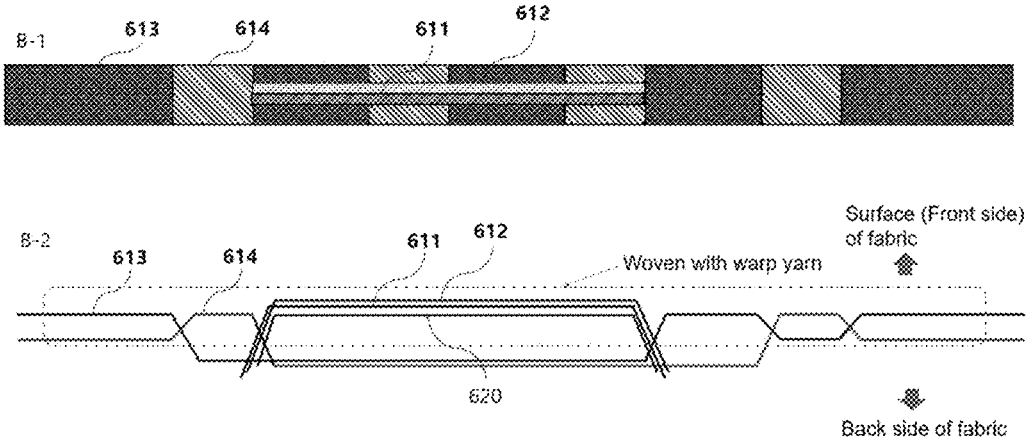
FIG. 6B is a schematic view of an exemplary embodiment of a fiber optic fabric according to the present invention.

FIGS. 6A and 6B schematically show another fiber optic fabric according to the present invention. In particular, FIG. 6A is a schematic view of the fabric that includes the pattern formation part with a first weft yarn, and the main body part with a first main body part weft yarn and a second main body part weft yarn. FIG. 6B is a schematic view of the fabric that includes the pattern formation part with a second weft yarn in addition to the first weft yarn, and the main body part with the first and second main body part weft yarns.

To elaborate, A-1 of FIG. 6A is a plan view of the fabric that includes the pattern formation part with a first weft yarn 611, and the main body part with a first main body part weft yarn 613 and a second main body part weft yarn 614; and A-2 in FIG. 6A is a front view of the fabric. Referring to FIG. 6A, the pattern formation part can be made by interweaving the first weft yarn 611 with first and second warp yarns (not shown), and the main body part can be made by interweaving the first and second main body part weft yarns 613, 614 with first and second main body part warp yarns (not shown). Here, the first main body part weft yarn 613 and the second main body part weft yarn 614 may be involved in the weaving process of making the main body part, and then withdrawn from the weaving process of making the pattern formation part by being taken out to the back side of the fabric from an interface between the fabric and the pattern formation part.

B-1 of FIG. 6B is a plan view of the fabric that includes the pattern formation part with the first weft yarn 611 as well as a second weft yarn 612, and the main body part with the first main body part weft yarn 613 and the second main body part weft yarn 614; and B-2 of FIG. 6B is a front view of the fabric. Referring to FIG. 6B, the first weft yarn and the second weft yarn are arranged alternately next to each other, as seen on the same plane. In particular, the plan view in B-1 of FIG. 6B shows that the first weft yarn 611 and the second weft yarn 612 are alternately arranged side by side, while the front view in B-2 of FIG. 6B shows that these two weft yarns are slightly out of phase such that both the weft yarns are visible, instead of having either the first weft yarn 611 or the second weft yarn 612 hidden from the view as they are actually overlapped when seen from the front view.

Referring back to FIG. 6B, the pattern formation part can be made by interweaving the first and second weft yarns 611, 612 with first and second warp yarns (not shown), and the main body part can be made by interweaving the first main body part weft yarn 613 with first and second main body part warp yarns (not shown). Here, the first main body part weft yarn 613 may be involved in the weaving process of making the main body part, and then withdrawn from the weaving process of making the pattern formation part by being taken out to the back side of the fabric from an interface between the fabric and the pattern formation part.

In this fabric having the first and second main body part weft yarns involved in the weaving process of making the main body part, and then withdrawn from the weaving process of making the pattern formation part by being taken out to the back side of the fabric from an interface between the fabric and the pattern formation part, the pattern formation part may further include a back-side weft yarn.

Having such a back-side weft yarn 620 at the back of the first weft yarn 511 as shown in FIGS. 6A and 6B, it becomes possible to prevent backward emission of light from the first weft yarn 611. That is, the back-side weft yarn 620 and the first weft yarn 611 are stacked one on top of the other, and in particular, the back-side weft yarn 620 is arranged at the back of the first weft yarn 611 as seen on the same plane of the fabric so that it becomes possible to prevent backward emission of the light from the first weft yarn 611 and maximize forward light emission.

In this pattern formation part, the back-side weft yarn 620 can be woven with at least one of first and second warp yarns (not shown). More details on the structure of the back-side weft yarn can be referred back to the description on any of the pattern formation parts discussed previously.

The first main body part weft yarn used for the fiber optic fabric in this embodiment can be prepared in such a way that it is continuously involved in the weaving process of making the main body part and the pattern formation member.

Figure 7A:
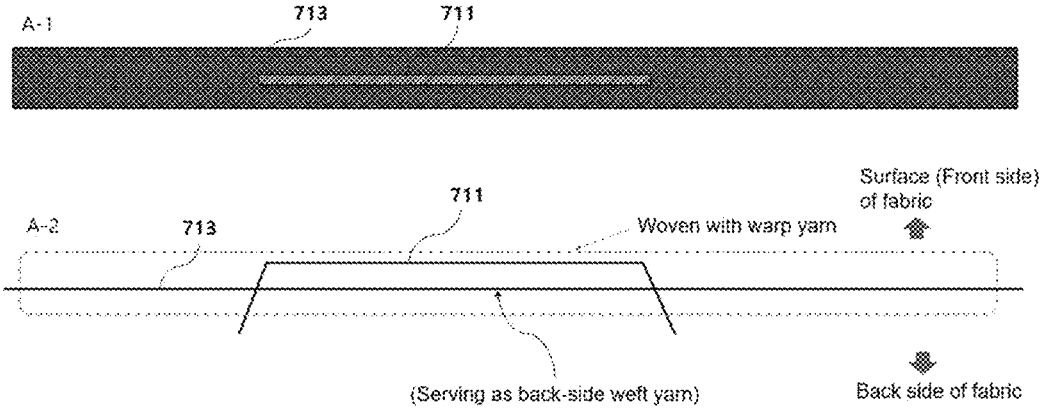
FIG. 7A is a schematic view of another exemplary embodiment of a fiber optic fabric according to the present invention.
Figure 7B:
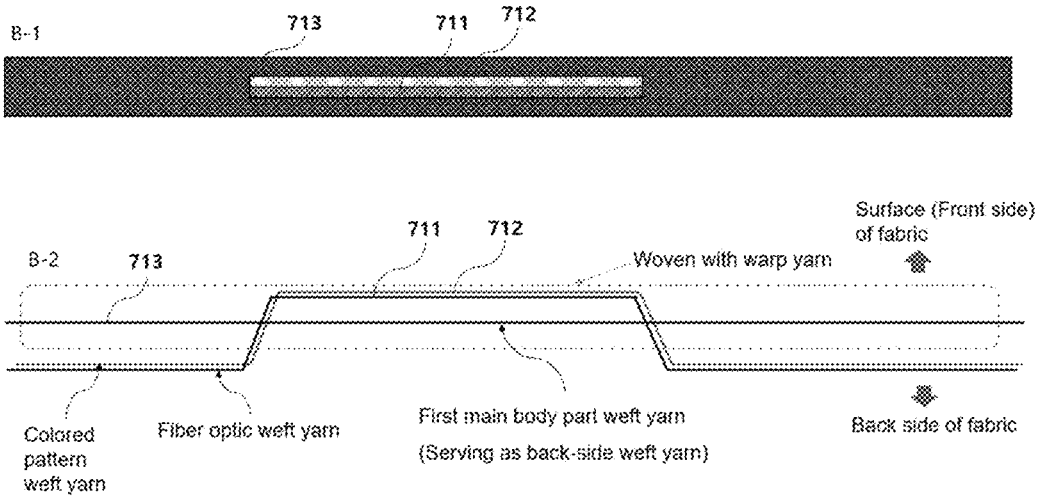
FIG. 7B is a schematic view of an exemplary embodiment of a fiber optic fabric according to the present invention.

FIGS. 7A and 7B schematically show another fiber optic fabric according to the present invention. In particular, FIG. 7A is a schematic view of the fabric that includes the pattern formation part with a first weft yarn, and the main body part with a first main body part weft yarn. FIG. 7B is a schematic view of the fabric that includes the pattern formation part with a second weft yarn in addition to the first weft yarn, and the main body part with the first main body part weft yarn.

To elaborate, A-1 of FIG. 7A is a plan view of the fabric that includes the pattern formation part with a first weft yarn 711, and the main body part with a first main body part weft yarn 713; and A-2 in FIG. 7A is a front view of the fabric. Referring to FIG. 7A, the pattern formation part can be made by interweaving the first weft yarn 711 with first and second warp yarns (not shown), and the main body part can be made by interweaving the first main body part weft yarn 713 with first and second main body part warp yarns (not shown). Here, the first main body part weft yarn 713 may be continuously involved in the weaving process of making the main body part and the pattern formation part. In this case, the first main body part weft yarn 713 is arranged at the back of the first weft yarn 711 of the pattern formation part so that it becomes possible to prevent backward emission of the light from the first weft yarn 711. In this way, the first main body part weft yarn 713 can serve as the back-side weft yarn discussed earlier. Also, the first main body part weft yarn 713 may be woven with at least one of the first warp yarn and the second warp yarn of the pattern formation part. More details on this weaving structure can be referred back to the description on the back-side warp yarn discussed previously.

B-1 of FIG. 7B is a plan view of the fabric that includes the pattern formation part with the first weft yarn 711 as well as a second weft yarn 712, and the main body part with the first main body part weft yarn 713; and B-2 of FIG. 7B is a front view of the fabric. Referring to FIG. 7B, the first weft yarn and the second weft yarn are arranged alternately next to each other, as seen on the same plane. In particular, the plan view in B-1 of FIG. 7B shows that the first weft yarn 7611 and the second weft yarn 712 are alternately arranged side by side, while the front view in B-2 of FIG. 7B shows that these two weft yarns are slightly out of phase such that both the weft yarns are visible, instead of having either the first weft yarn 711 or the second weft yarn 712 hidden from the view as they are actually overlapped when seen from the front view.

Referring back to FIG. 7B, the pattern formation part can be made by interweaving the first and second weft yarns 711, 712 with first and second warp yarns (not shown), and the main body part can be made by interweaving the first main body part weft yarn 713 with first and second main body part warp yarns (not shown).

Here, the first main body part weft yarn 713 may be continuously involved in the weaving process of making the main body part and the pattern formation part. In this case, the first main body part weft yarn 713 is arranged at the back of the first weft yarn 711 of the pattern formation part so that it becomes possible to prevent backward emission of the light from the first weft yarn 711. In this way, the first main body part weft yarn 713 can serve as the back-side weft yarn discussed earlier. Also, the first main body part weft yarn 713 may be woven with at least one of the first warp yarn and the second warp yarn of the pattern formation part. More details on this weaving structure can be referred back to the description on the back-side warp yarn discussed previously.

In this embodiment of the main body part that further includes the second main body part weft yarns, the first main body part weft yarn and/or second main body part weft yarn may be continuously involved in the weaving process of making the main body part and the pattern formation part.

Figure 8A:
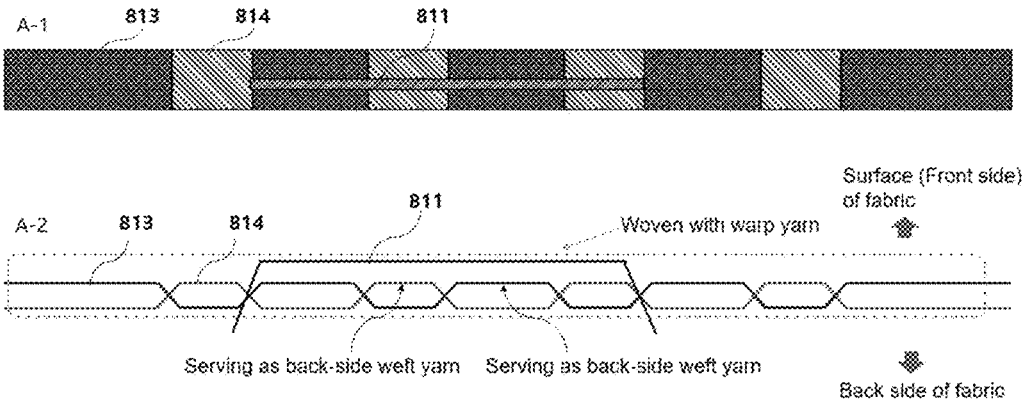
FIG. 8A is a schematic view of another exemplary embodiment of a fiber optic fabric according to the present invention.
Figure 8B:
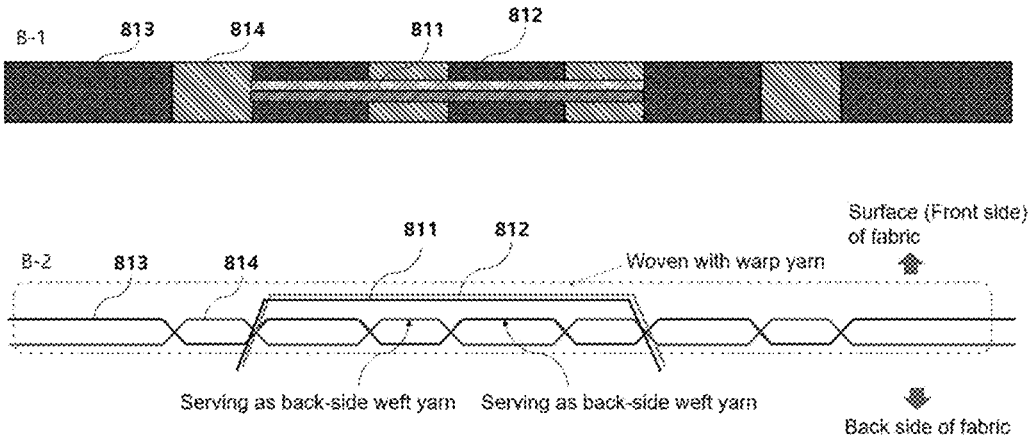
FIG. 8B is a schematic view of an exemplary embodiment of a fiber optic fabric according to the present invention.

FIGS. 8A and 8B schematically show another fiber optic fabric according to the present invention. In particular, FIG. 8A is a schematic view of the fabric that includes the pattern formation part with a first weft yarn, and the main body part with a first main body part weft yarn and a second main body part weft yarn. FIG. 8B is a schematic view of the fabric that includes the pattern formation part with a second weft yarn in addition to the first weft yarn, and the main body part with the first and second main body part weft yarns.

To elaborate, A-1 of FIG. 8A is a plan view of the fabric that includes the pattern formation part with a first weft yarn 811, and the main body part with a first main body part weft yarn 813 and a second main body part weft yarn 814; and A-2 in FIG. 8A is a front view of the fabric. Referring to FIG. 8A, the pattern formation part can be made by interweaving the first weft yarn 811 with first and second warp yarns (not shown), and the main body part can be made by interweaving the first and second main body part weft yarns 813, 814 with first and second main body part warp yarns (not shown). Here, the first main body part weft yarn 813 and/or second main body part weft yarn 814 may be continuously involved in the weaving process of making the main body part and the pattern formation part. In this case, the first main body part weft yarn 813 and/or the second main body part weft yarn 814 can be arranged at the back of the first weft yarn 811 of the pattern formation part so that it becomes possible to prevent backward emission of light from the first weft yarn 811. In this way, the first main body part weft yarn 813 and/or the second main body part weft yarn 814 can serve as the back-side weft yarn discussed earlier. Also, the first main body part weft yarn 813 and/or the second main body part weft yarn 814 may be woven with at least one of the first warp yarn and the second warp yarn of the pattern formation part. More details on this weaving structure can be referred back to the description on the back-side warp yarn discussed previously.

B-1 of FIG. 8B is a plan view of the fabric that includes the pattern formation part with the first weft yarn 811 as well as a second weft yarn 812, and the main body part with the first main body part weft yarn 813 and the second main body part weft yarn 814; and B-2 of FIG. 8B is a front view of the fabric. Referring back to FIG. 8B, the pattern formation part can be made by interweaving the first and second weft yarns 811, 812 with first and second warp yarns (not shown), and the main body part can be made by interweaving the first and second main body part weft yarns 813, 814 with first and second main body part warp yarns (not shown).

Here, the first main body part weft yarn 813 and/or the second main body part weft yarn 814 may be continuously involved in the weaving process of making the main body part and the pattern formation part. In this case, the first main body part weft yarn 813 and/or the second main body part weft yarn 814 can be arranged at the back of the first weft yarn 811 of the pattern formation part so that it becomes possible to prevent backward emission of the light from the first weft yarn 811. In this way, the first main body part weft yarn 813 and/or the second main body part weft yarn 814 can serve as the back-side weft yarn discussed earlier. Also, the first main body part weft yarn 813 and/or the second main body part weft yarn 814 may be woven with at least one of the first warp yarn and the second warp yarn of the pattern formation part. More details on this weaving structure can be referred back to the description on the back-side warp yarn discussed previously.

In this exemplary embodiment of the fiber optic fabric in another aspect of the present invention, the first weft yarn and/or the second weft yarn can be involved in the weaving process of making the pattern formation part, and then withdrawn from the weaving process of making the main body part by being taken out to the back side of the fabric from an interface between the fabric and the pattern formation part.

In this exemplary embodiment of the fiber optic fabric in another aspect of the present invention, the first weft yarn and/or the second weft yarn may be continuously involved in the weaving process of making the main body part and the pattern formation part.

Another aspect of the present invention provides an (shoe) upper including a pattern formation part according to any of the exemplary embodiments described above.

Another aspect of the present invention provides an (shoe) upper including a fiber optic fabric according to any of the exemplary embodiments described above.

Yet another aspect of the present invention provides a shoe including an (shoe) upper according to any of the exemplary embodiments described above.

Figure 9:
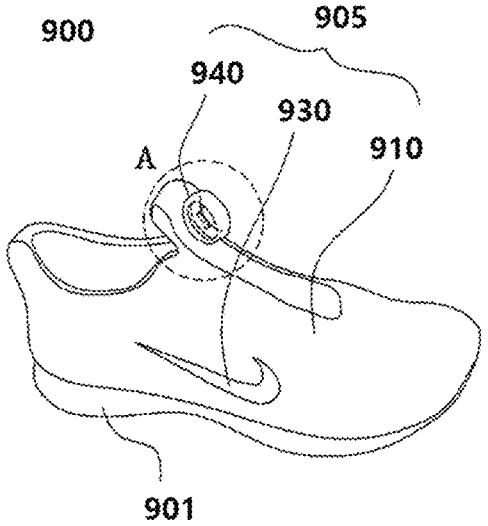
FIG. 9 is a schematic view of an exemplary embodiment of a show according to the present invention.

FIG. 9 is a schematic view showing a shoe 900 according to one aspect of the present invention.

Referring to FIG. 9, the shoe 900 includes a sole 901 which is a part making contact with the floor or ground, and an upper 905 which is coupled with the sole 101 to form the shoe 900. The upper 905 includes a main body 910, a pattern formation part 930, and a lighting unit 940. Light from the lighting unit 940 is emitted outside through the pattern formation part 930, causing a logo on the shoe 900 to illuminate. The main body 910 is coupled with the sole 901 to encompass the foot of the shoe 900's wearer.

Figure 10:
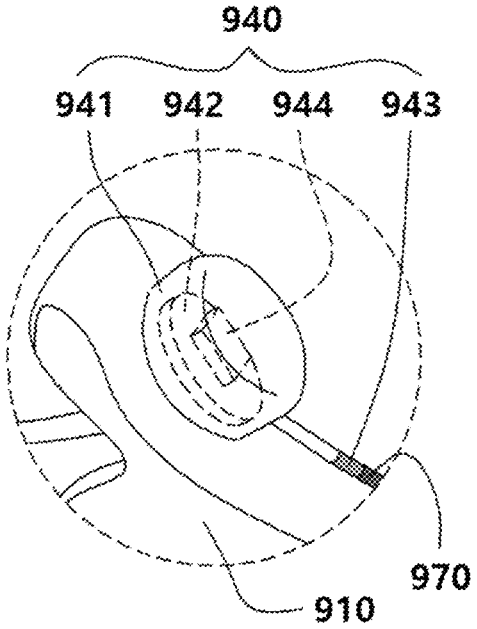
FIG. 10 is a schematic view showing a lighting unit that may be included in an exemplary embodiment of a show according to the present invention.

FIG. 10 is a schematic view showing the lighting unit 940 included in a shoe according to one aspect of the present invention. The lighting unit 940 serves to provide light to the pattern formation part 930 for illumination. In particular, the lighting unit 940 includes a battery 942, a light-emitting element 943, and a switch 944. The battery 942 supplies electricity for light emission. One example of the battery 942 can be a portable battery but is not limited thereto. Upon receiving the electricity from the battery 942, the light-emitting element 943 emits light of an intended color, such as, red, green, or blue, and transmits the light through the optical fiber. One example of the light-emitting element 943 is an LED but is not limited thereto. The switch 944 is used for inputting an operation command to the light-emitting element 943. One example of the switch 944 is a push button but is not limited thereto. Additionally, there is a lighting cover 941 that encompasses the battery 942 and the switch 944 for protection.

Figure 11:
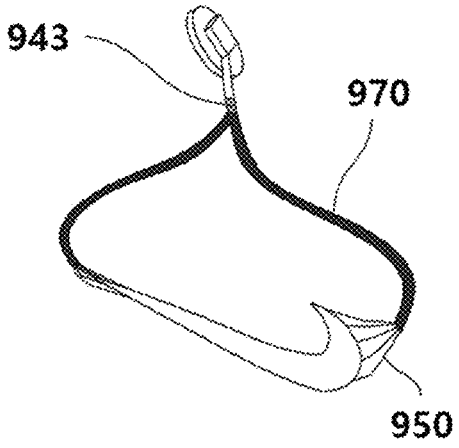
FIG. 11 is a schematic view showing a fiber optic weft yarn of the pattern formation part weft yarn is extended to the lighting unit, in an exemplary embodiment of the present invention.

FIG. 11 is a schematic view showing that a fiber optic weft yarn 500 of the pattern formation part extends to the light-emitting element, in an exemplary embodiment of the present invention.

As shown in FIG. 11, the fiber optic weft yarn 500 as the weft yarn of the pattern formation part extends to the light-emitting element 943 so as to deliver light from the light-emitting element 943, causing the pattern formation part to illuminate its pattern. As described earlier, in one exemplary embodiment, any of side lighting fibers and end lighting fibers are suitable for the weft yarns in the present invention. A plurality of the fiber optic weft yarns 950 may be woven across the entire pattern formation part 930, and any bundle left over at the distal end from the pattern formation part 930 is tied together by a cable 970 made of an opaque (e.g. black) material. As such, light from those optical fibers covered with the cable 970 is trapped inside and can be transmitted outside mainly through the pattern formation part 930 containing optical fibers. Ends of the side lighting weft yarns and the end lighting weft yarns may be configured for handling according to the present invention.

As discussed in the foregoing description, the upper includes the main body, the pattern formation part, and the lighting unit, in which the pattern formation part may be formed integrally with the upper. Hence, the manufacturing time for the upper with an illumination feature can be reduced, leading to an improved manufacturing efficiency. In addition, the illuminating pattern formation part is much less likely to come off and there is no need for an adhesive or bonding, creating an aesthetically attractive appearance from outside.

It will be appreciated that several of the above-disclosed and other features and functions, or alternatives thereof, may be desirably combined into many other different systems or applications. It will also be appreciated that various presently unforeseen or unanticipated alternatives, modifications, variations, or improvements therein may be subsequently made by those skilled in the art which alternatives, variations and improvements are also intended to be encompassed by the following claims.

Set out below are clauses that describe features of further aspect of the present invention.

(1) A pattern formation part forming a fiber optic pattern on the surface, the pattern formation part being comprised of: a leno-weave fabric made by interweaving first warp yarns 221 which are transparent warp yarns and transmit at least part of light and second warp yarns 222 which are opaque warp yarns with first weft yarns 271 which are fiber optic weft yarns, with the first warp yarns 221 and the second warp yarns 222 being twisted in opposite direction around the first weft yarns 271, the first weft yarns 271 forming a fiber optic pattern on the surface, and the first weft yarns 271 always going under the first warp yarns 221 and always going over the second warp yarns 222 during weaving, wherein the pattern forming part further comprises: second weft yarns 271' which are alternately arranged with the first weft yarns 271 next to each other as seen on the same plane of the pattern formation part, and during weaving, the first and second weft yarns 271, 271' run together through the same slots or run separately through different slots that are formed by the first and second warp yarns 221, 222, with the second weft yarns 271' always going under the first warp yarns 221 and always going over the second warp yarns 222, and the second weft yarns 271' are pattern formation weft yarns of a certain color for creating a pattern when the first weft yarns 271 are not illuminated.

(2) A pattern formation part forming a fiber optic pattern on the surface, the pattern formation part being comprised of: a leno-weave fabric made by interweaving first and second warp yarns 221, 222 with first weft yarns 271 which are fiber optic weft yarns, with the first warp yarns 221 and the second warp yarns 222 being twisted in opposite direction around the first weft yarns 271, the first weft yarns 271 forming a fiber optic pattern on the surface, and both the first warp yarns 221 and the second warp yarns 222 being transparent warp yarns that transmit at least part of light, wherein the pattern forming part further comprises: second weft yarns 271' which are alternately arranged with the first weft yarns 271 next to each other as seen on the same plane of the pattern formation part, and during weaving, the first and second weft yarns 271, 271' run together through the same slots or run separately through different slots that are formed by the first and second warp yarns 221, 222, and the second weft yarns 271' are pattern formation weft yarns of a certain color for creating a pattern when the first weft yarns 271 are not illuminated.

(3) The pattern formation part further comprising: back-side weft yarns 520 which are provided at the back of the first weft yarns 511 to prevent backward emission of light from the first weft yarns 511, with the back-side weft yarns 520 being involved in weaving with the first warp yarns and second warp yarns.

(4) A fiber optic fabric comprising: a pattern formation part 310 forming a fiber optic pattern on the surface, and a main body part 320 having a surface free of optical fibers, wherein the pattern formation part 310 being comprised of: a leno-weave fabric made by interweaving first warp yarns 311 which are transparent warp yarns and transmit at least part of light and second warp yarns 312 which are opaque warp yarns with first weft yarns 313 which are fiber optic weft yarns, with the first warp yarns 311 and the second warp yarns 312 being twisted in opposite direction around the first weft yarns 313, the first weft yarns 313 forming a fiber optic pattern on the surface, and the first weft yarns 313 always going under the first warp yarns 311 and always going over the second warp yarns 312 during weaving; and the main body part 320 being comprised of: a leno-weave fabric made by interweaving first and second main body part warp yarns 321, 322 with first main body part weft yarns 323, with the first and second main body part warp yarns 321, 322 being twisted in opposite direction around the first main body part weft yarns 323, wherein the fiber optic fabric being formed by the pattern formation part 310 and the main body part 320 in which the first warp yarns 311 and the second warp yarns 312 of the pattern formation part 310 are continued across the main body part 320, forming first main body warp yarns 321' and second main body part warp yarns 322', and wherein the pattern forming part 310 further comprises: second weft yarns 314 which are alternately arranged with the first weft yarns 313 next to each other as seen on the same plane of the pattern formation part 310, and during weaving, the first and second weft yarns 313, 314 run together through the same slots or run separately through different slots that are formed by the first and second warp yarns 311, 312, with the second weft yarns 314 always going under the first warp yarns 311 and always going over the second warp yarns 312, and the second weft yarns 314 are pattern formation weft yarns of a certain color for creating a pattern when the first weft yarns 313 are not illuminated.

(5) A fiber optic fabric comprising: a pattern formation part 310 forming a fiber optic pattern on the surface, and a main body part 320 having a surface free of optical fibers, wherein the pattern formation part 310 being comprised of: a leno-weave fabric made by interweaving first and second warp yarns 311, 312 with first weft yarns 313 which are fiber optic weft yarns, with the first warp yarns 311 and the second warp yarns 312 being twisted in opposite direction around the first weft yarns 313, the first weft yarns 313 forming a fiber optic pattern on the surface, and both the first warp yarns 311 and the second warp yarns 312 being transparent warp yarns that transmit at least part of light; and the main body part 320 being comprised of: a leno-weave fabric made by interweaving first and second main body part warp yarns 321, 322 with first main body part weft yarns 323, with the first and second main body part warp yarns 321, 322 being twisted in opposite direction around the first main body part weft yarns 323, wherein the fiber optic fabric being formed by the pattern formation part 310 and the main body part 320 in which the first warp yarns 311 and the second warp yarns 312 of the pattern formation part 310 are continued across the main body part 320, forming first main body warp yarns 321' and second main body part warp yarns 322', and wherein the pattern forming part 310 further comprises: second weft yarns 314 which are alternately arranged with the first weft yarns 313 next to each other as seen on the same plane of the pattern formation part 310, and during weaving, the first and second weft yarns 313, 314 run together through the same slots or run separately through different slots that are formed by the first and second warp yarns 311, 312, and the second weft yarns 314 are pattern formation weft yarns of a certain color for creating form a pattern when the first weft yarns 313 are not illuminated.

(6) The fiber optic fabric, wherein the main body part further comprises second main body part weft yarns 414 such that the first and second main body part weft yarns 413, 414 are stacked one on top of the other and interwoven with the first and second main body part warp yarns, and wherein, in at least one portion of the fiber optic fabric, the first main body part weft yarns 413 are exposed on the surface, and the second main body part weft yarns 414 are disposed on the back side such that a pattern of the first main body part weft yarns 413 is formed on the surface of the main body part, and in at least another portion of the fiber optic fabric, positions of the first and second main body part weft yarns 413, 414 are switched around, the first main body part weft yarns 413 being disposed on the back side, and the second main body part weft yarns 414 being exposed on the surface, such that a pattern of the second main body part weft yarns 414 is formed on the surface of the main body part.

(7) The fiber optic fabric, wherein the main body part weft yarns 513 are involved in the weaving process of making the main body part, and then withdrawn from the weaving process of making the pattern formation part by being taken out to the back side of the fabric from an interface between the fabric and the pattern formation part.

(8) The fiber optic fabric, wherein the pattern formation part further comprises back-side weft yarns 520 provided at the back of the first weft yarns 511 to prevent backward emission of light from the first weft yarns 511, with the back-side weft yarns 520 being involved in weaving with the first and second warp yarns.

(9) The fiber optic fabric, wherein the first main body part weft yarns 613 and the second main body part weft yarns 614 are involved in the weaving process of making the main body part, and then withdrawn from the weaving process of making the pattern formation part by being taken out to the back side of the fabric from an interface between the main body part and the pattern formation part.

(10) The fiber optic fabric, wherein the pattern formation part further comprises back-side weft yarns 620 provided at the back of the first weft yarns 611 to prevent backward emission of light from the first weft yarns 611, with the back-side weft yarns 620 being involved in weaving with the first and second warp yarns.

(11). The fiber optic fabric, wherein the first main body part weft yarns 713 are continuously involved in the weaving process of making the main body part and the pattern formation part, with the first main body part weft yarns 713 being provided at the back of the first weft yarns 711 of the pattern formation part to prevent backward emission of light from the first weft yarns 711, and the first main body part weft yarns 713 are interwoven with the first and second warp yarns.

(12) The fiber optic fabric, wherein the first main body part weft yarns 813 or the second main body part weft yarns 814 are continuously involved in the weaving process of making the main body part and the pattern formation part, with the first main body part weft yarns 813 or the second main body part weft yarns 814 being provided at the back of the first weft yarns 811 of the pattern formation part to prevent backward emission of light from the first weft yarns 811, and the first main body part weft yarns 813 or the second main body part weft yarns 814 are interwoven with the first and second warp yarns.

(13) A shoe upper comprising the pattern formation part.

(14) A shoe upper comprising the fiber optic fabric.

(15) A shoe comprising the shoe upper.

In the upper with an illuminating logo and shoes having the upper according to an aspect of the present invention, the light-emitting element can be formed integrally with the shoe upper such that the industrial availability of the shoes may be increased.

What is claimed is:

1. A pattern formation part forming a fiber optic pattern on the surface, the pattern formation part being comprised of:

a leno-weave fabric made by interweaving first warp yarns which are transparent warp yarns and transmit at least part of light and second warp yarns which are opaque warp yarns with first weft yarns which are fiber optic weft yarns, with the first warp yarns and the second warp yarns being twisted in opposite direction around the first weft yarns, the first weft yarns forming a fiber optic pattern on the surface, and the first weft yarns always going under the first warp yarns and always going over the second warp yarns during weaving, wherein the pattern forming part further comprises: second weft yarns which are alternately arranged with the first weft yarns next to each other as seen on the same plane of the pattern formation part, and during weaving, the first and second weft yarns run together through the same slots or run separately through different slots that are formed by the first and second warp yarns, with the second weft yarns always going under the first warp yarns and always going over the second warp yarns, and the second weft yarns are pattern formation weft yarns of a certain color for creating a pattern when the first weft yarns are not illuminated.

2. A pattern formation part forming a fiber optic pattern on the surface, the pattern formation part being comprised of:

a leno-weave fabric made by interweaving first and second warp yarns with first weft yarns which are fiber optic weft yarns, with the first warp yarns and the second warp yarns being twisted in opposite direction around the first weft yarns, the first weft yarns forming a fiber optic pattern on the surface, and both the first warp yarns and the second warp yarns being transparent warp yarns that transmit at least part of light, wherein the pattern forming part further comprises: second weft yarns which are alternately arranged with the first weft yarns next to each other as seen on the same plane of the pattern formation part, and during weaving, the first and second weft yarns run together through the same slots or run separately through different slots that are formed by the first and second warp yarns, and the second weft yarns are pattern formation weft yarns of a certain color for creating a pattern when the first weft yarns are not illuminated.

3. The pattern formation part according to claim 1, further comprising: back-side weft yarns which are provided at the back of the first weft yarns to prevent backward emission of light from the first weft yarns, with the back-side weft yarns being involved in weaving with the first warp yarns and second warp yarns.

4. A fiber optic fabric comprising:

a pattern formation part forming a fiber optic pattern on the surface, and a main body part having a surface free of optical fibers, wherein the pattern formation part being comprised of:

a leno-weave fabric made by interweaving first warp yarns which are transparent warp yarns and transmit at least part of light and second warp yarns which are opaque warp yarns with first weft yarns which are fiber optic weft yarns, with the first warp yarns and the second warp yarns being twisted in opposite direction around the first weft yarns, the first weft yarns forming a fiber optic pattern on the surface, and the first weft yarns always going under the first warp yarns and always going over the second warp yarns during weaving; and the main body part being comprised of:

a leno-weave fabric made by interweaving first and second main body part warp yarns with first main body part weft yarns, with the first and second main body part warp yarns being twisted in opposite direction around the first main body part weft yarns, wherein the fiber optic fabric being formed by the pattern formation part and the main body part in which the first warp yarns and the second warp yarns of the pattern formation part are continued across the main body part, forming first main body warp yarns and second main body part warp yarns, and wherein the pattern forming part further comprises: second weft yarns which are alternately arranged with the first weft yarns next to each other as seen on the same plane of the pattern formation part, and during weaving, the first and second weft yarns run together through the same slots or run separately through different slots that are formed by the first and second warp yarns, with the second weft yarns always going under the first warp yarns and always going over the second warp yarns, and the second weft yarns are pattern formation weft yarns of a certain color for creating a pattern when the first weft yarns are not illuminated.

5. A fiber optic fabric comprising:

a pattern formation part forming a fiber optic pattern on the surface, and a main body part having a surface free of optical fibers, wherein the pattern formation part being comprised of:

a leno-weave fabric made by interweaving first and second warp yarns with first weft yarns which are fiber optic weft yarns, with the first warp yarns and the second warp yarns being twisted in opposite direction around the first weft yarns, the first weft yarns forming a fiber optic pattern on the surface, and both the first warp yarns and the second warp yarns being transparent warp yarns that transmit at least part of light; and the main body part being comprised of:

a leno-weave fabric made by interweaving first and second main body part warp yarns with first main body part weft yarns, with the first and second main body part warp yarns being twisted in opposite direction around the first main body part weft yarns, wherein the fiber optic fabric being formed by the pattern formation part and the main body part in which the first warp yarns and the second warp yarns of the pattern formation part are continued across the main body part, forming first main body warp yarns and second main body part warp yarns, and wherein the pattern forming part further comprises: second weft yarns which are alternately arranged with the first weft yarns next to each other as seen on the same plane of the pattern formation part, and during weaving, the first and second weft yarns run together through the same slots or run separately through different slots that are formed by the first and second warp yarns, and the second weft yarns are pattern formation weft yarns of a certain color for creating form a pattern when the first weft yarns are not illuminated.

6. The fiber optic fabric according to claim 4, wherein the main body part further comprises second main body part weft yarns such that the first and second main body part weft yarns are stacked one on top of the other and interwoven with the first and second main body part warp yarns, and wherein, in at least one portion of the fiber optic fabric, the first main body part weft yarns are exposed on the surface, and the second main body part weft yarns are disposed on the back side such that a pattern of the first main body part weft yarns is formed on the surface of the main body part, and in at least another portion of the fiber optic fabric, positions of the first and second main body part weft yarns are switched around, the first main body part weft yarns being disposed on the back side, and the second main body part weft yarns being exposed on the surface, such that a pattern of the second main body part weft yarns is formed on the surface of the main body part.

7. The fiber optic fabric according to claim 4, wherein the main body part weft yarns are involved in the weaving process of making the main body part, and then withdrawn from the weaving process of making the pattern formation part by being taken out to the back side of the fabric from an interface between the fabric and the pattern formation part.

8. The fiber optic fabric according to claim 7, wherein the pattern formation part further comprises back-side weft yarns provided at the back of the first weft yarns to prevent backward emission of light from the first weft yarns, with the back-side weft yarns being involved in weaving with the first and second warp yarns.

9. The fiber optic fabric according to claim 6, wherein the first main body part weft yarns and the second main body part weft yarns are involved in the weaving process of making the main body part, and then withdrawn from the weaving process of making the pattern formation part by being taken out to the back side of the fabric from an interface between the main body part and the pattern formation part.

10. The fiber optic fabric according to claim 9, wherein the pattern formation part further comprises back-side weft yarns provided at the back of the first weft yarns to prevent backward emission of light from the first weft yarns, with the back-side weft yarns being involved in weaving with the first and second warp yarns.

11. The fiber optic fabric according to claim 4, wherein the first main body part weft yarns are continuously involved in the weaving process of making the main body part and the pattern formation part, with the first main body part weft yarns being provided at the back of the first weft yarns of the pattern formation part to prevent backward emission of light from the first weft yarns, and the first main body part weft yarns are interwoven with the first and second warp yarns.

12. The fiber optic fabric according to claim 6, wherein the first main body part weft yarns or the second main body part weft yarns are continuously involved in the weaving process of making the main body part and the pattern formation part, with the first main body part weft yarns or the second main body part weft yarns being provided at the back of the first weft yarns of the pattern formation part to prevent backward emission of light from the first weft yarns, and the first main body part weft yarns or the second main body part weft yarns are interwoven with the first and second warp yarns.

13. A shoe upper comprising the pattern formation part according to claim 1.

14. A shoe upper comprising the fiber optic fabric according to claim 4.

15. A shoe comprising the shoe upper according to claim 13.

16. A shoe comprising the shoe upper according to claim 14.

* * * * *